US010654696B2

(12) United States Patent
Wu

(10) Patent No.: US 10,654,696 B2
(45) Date of Patent: May 19, 2020

(54) HYDRAULIC JACK CAPABLE OF QUICKLY LIFTING LOAD

(71) Applicant: HANGZHOU YINGJIANG MACHINERY MANUFACTURE CO., LTD., Hangzhou, Zhejiang Province (CN)

(72) Inventor: Shenghua Wu, Hangzhou (CN)

(73) Assignee: HANGZHOU YINGJIANG MACHINERY MANUFACTURE CO., LTD., Hangzhou, Zhejiang Province (CN)

( * ) Notice: Subject to any disclaimer, the term of this patent is extended or adjusted under 35 U.S.C. 154(b) by 701 days.

(21) Appl. No.: 15/325,709

(22) PCT Filed: Apr. 1, 2015

(86) PCT No.: PCT/CN2015/075675
§ 371 (c)(1),
(2) Date: Jan. 11, 2017

(87) PCT Pub. No.: WO2016/138685
PCT Pub. Date: Sep. 9, 2016

(65) Prior Publication Data

US 2017/0158473 A1 Jun. 8, 2017

(30) Foreign Application Priority Data

Mar. 4, 2015 (CN) ..... 2015 2 0126076 U

(51) Int. Cl.
*B66F 3/42* (2006.01)
*B66F 5/04* (2006.01)

(52) U.S. Cl.
CPC . *B66F 3/42* (2013.01); *B66F 5/04* (2013.01)

(58) Field of Classification Search
CPC ..... B66F 3/42; B66F 3/26; B66F 5/04; F04B 9/14
(Continued)

(56) References Cited

U.S. PATENT DOCUMENTS 3,593,520 A * 7/1971 Laundy ..... B66F 3/42 60/430
3,742,817 A * 7/1973 Wenzel ..... B66F 3/42 91/444

(Continued)

*Primary Examiner* — Orlando E Aviles
*Assistant Examiner* — Seahee Yoon
(74) *Attorney, Agent, or Firm* — Muncy, Geissler, Olds & Lowe, P.C.

(57) ABSTRACT

A hydraulic jack capable of quickly lifting a load includes a frame (1) mounted with a lifting arm (2), a long connecting rod, a tray (4), a bracket and a hydraulic oil pump (3) for driving the lifting arm (2), and further includes a large pump (11) and a small pump (12) for supplying high pressure oil to the hydraulic oil pump (3). An inner cavity of the large pump (1) and a small pump core are axially connected to a hand press (8) respectively. The inner cavity of the large pump (11) is in communication with a first pressure regulation mechanism (9), and the inner cavity of the small pump (12) is in communication with a second pressure regulation mechanism (10). The first pressure regulation mechanism (9) comprise a first upper valve body (90) mounted on a lower valve body (33), a first oil outlet (91) of a communicating oil compartment (32) provided on a side wall thereof, and a first oil inlet (92) provided at a bottom thereof, the first oil inlet (92) being in communication with the inner cavity of the large of the large pump (11). A central hole of the first upper valve body (90) is sequentially provided from bottom to top with a first lower steel ball (93) capable of blocking the first oil inlet (92), a first ball valve base (94), a first pressure spring (95), a first valve core (96) and a first valve rod (97), the first pressure spring (95) being disposed (Continued)

between the first ball valve base (94) and the first valve core (96). The second pressure regulation mechanism (10) and the first pressure regulation mechanism (9) have the same structure.

5 Claims, 11 Drawing Sheets

(58) Field of Classification Search
USPC ..... 254/8 B, 93 H, 93 R; 60/477, 478, 479
See application file for complete search history.

(56) References Cited

U.S. PATENT DOCUMENTS 4,018,421 A * 4/1977 Tallman ..... B66F 5/04 254/8 B
4,334,667 A * 6/1982 Fox ..... B66F 5/04 251/251
5,755,099 A * 5/1998 Hung ..... B66F 5/04 60/479
6,295,812 B1 * 10/2001 Hsu ..... B66F 5/04 254/93 H
6,923,431 B2 * 8/2005 Yueh ..... B66F 3/25 254/8 B
2002/0153514 A1 * 10/2002 Wixey ..... B66F 5/04 254/8 B
2003/0230084 A1 * 12/2003 Tang ..... B66F 3/42 60/477
2004/0016231 A1 * 1/2004 Tang ..... B66F 3/42 60/479
2004/0065082 A1 * 4/2004 Zhong ..... B66F 5/04 60/479
2004/0065871 A1 * 4/2004 Hsu ..... B66F 5/04 254/8 B
2004/0172938 A1 * 9/2004 Hung ..... B66F 3/42 60/478
2005/0226744 A1 * 10/2005 Yueh ..... B66F 3/25 417/415
2010/0252791 A1 * 10/2010 Lancione ..... B66F 3/25 254/93 R
2010/0294964 A1 * 11/2010 Matsumoto ..... F16K 7/14 251/129.01

* cited by examiner

HYDRAULIC JACK CAPABLE OF QUICKLY LIFTING LOAD

This is a U.S. national stage application of PCT Application No. PCT/CN2015/075675 under 35 U.S.C. 371, filed Apr. 1, 2015 in Chinese, claiming priority from Chinese Patent Application No. 201520126076.9 filed Mar. 4, 2015, all of which are hereby incorporated by reference.

FIELD OF THE INVENTION

The present invention relates to a hydraulic jack capable of quickly lifting a load.

BACKGROUND

A hydraulic jack is a well-known simple lifting equipment used in mechanical and electrical equipment, vehicle maintenance, earthquake relief, etc. It has such advantages as simple structure, small size, easy operation, high lifting capacity, etc. The existing hydraulic jacks usually adopt the slow lifting mode of increasing top pressure with hydraulic oil increment. The hydraulic oil pump of hydraulic jack is generally composed of a hood, an outer cylinder jacket, a piston rod, a cylinder, a valve body, a large pump core and a small pump core mounted on the valve body, etc. During working, by operating a handle of the hydraulic oil pump, a certain volume of hydraulic oil can be pressed in the inner cavity of cylinder, so as to lift the piston rod.

When the existing hydraulic jack is lifting quickly under no-load condition, the pressure regulating valve of the large pump is adjusted to a low pressure, at this time, the large pump only works under no-load condition, and under the joint action of the large and small pumps, it can achieve quick lifting. When there is load, the pressure regulating valve of the large pump unloads, only the small pump works, and the load is lifted slowly. However, when the existing jack is in a light load condition, only the small pump works, at this time, the jacking speed is slow and the travel time is long, and it is time-consuming and labor-intensive, with low efficiency.

SUMMARY OF THE INVENTION

In order to overcome above drawbacks of the existing hydraulic jack under a light load condition, the present invention provides a hydraulic jack capable of quickly lifting a load which is safe and reliable and has a high light-load lifting speed.

In order to achieve the objects, the present invention employs the following technical solutions:

A hydraulic jack capable of quickly lifting a load, comprising a frame with front and rear wheels mounted with a lifting arm, a long connecting rod, a tray, a bracket and a hydraulic oil pump for driving the lifting arm, a handle connected with the hydraulic oil pump through a hand press, and further includes a large pump and a small pump for supplying high pressure oil to the hydraulic oil pump, an inner cavity of the large pump and an inner cavity of the small pump are respectively in communication with a hydraulic ram, and a large pump core and a small pump core are axially connected to the hand press respectively, and top surfaces of the large pump core and that of the small pump core are in contact with rollers mounted on the hand press respectively; wherein the inner cavity of the large pump is in communication with a first pressure regulation mechanism, and the inner cavity of the small pump is in communication with a second pressure regulation mechanism.

The first pressure regulation mechanism comprises a first upper valve body mounted on a lower valve body, a first oil outlet communicating with an oil compartment and the first upper valve body is provided on a side wall thereof, and a first oil inlet communicating with the inner cavity of the large pump is provided at the bottom thereof; a central hole of the first upper valve body is sequentially provided from a bottom to a top with a first lower steel ball capable of blocking the first oil inlet, a first ball valve base, a first pressure spring, a first valve core and a first valve rod, the first pressure spring being installed between the first ball valve base and the first valve core, and the first valve rod is provided with a first central through-hole where a first thimble passes through and a lower end of the first central through-hole is connected with the first valve core, and the first thimble drives the first valve core to move up and down along the axis of the first upper valve body; a first adjustment screw nut for adjusting the set pressure is installed on the top of the first valve rod, and the lower end of the first adjustment screw nut is connected fixedly with the lower valve body through a first stop pin; the top of the first adjustment screw nut is provided an opening where a first upper steel ball is provided, the lower end of the first upper steel ball leans against the first thimble;

The second pressure regulation mechanism comprises a second upper valve body mounted on the lower valve body, a second oil outlet communicating with the oil compartment and the second upper valve body provided on a side wall thereof, and a second oil inlet communicating the inner cavity of the small pump is provided at the bottom thereof; a central hole of the second upper valve body is sequentially provided from a bottom to a top with a second lower steel ball capable of blocking the second oil inlet, a second ball valve base, a second pressure spring, a second valve core and a second valve rod, the second pressure spring being installed between the second ball valve base and the second valve core, and the second valve rod is provided with a second central through-hole where a second thimble passes through and a lower end of the second central through-hole is connected with the second valve core, and the second thimble drives the second valve core to move up and down along the axis of the second upper valve body; a second adjustment screw nut for adjusting the set pressure is installed on the top of the second valve rod, and the lower end of the second adjustment screw nut is connected fixedly with a lower valve body through a second stop pin; the top of the second adjustment screw nut is provided an opening where a second upper steel ball is provide, the lower end of the second upper steel ball leans against the second thimble;

A first cam installed at the bottom of a first driving lever and hinged at the top of the first upper valve body leans against the upper end of the first upper steel ball; a second cam installed at the bottom of a second driving lever and hinged at the top of the second upper valve body leans against the upper end of the second upper steel ball; the ends of the connecting rod are hinged on the first driving lever and the second driving lever, respectively; a phase of the first cam is opposite to that of the second cam.

The first upper steel ball is mounted in a first mounting base, the second upper steel ball is mounted in a second mounting base, the first mounting base is provided with a first through groove where the first upper steel ball moving upwards and downwards, and the second mounting base is provided with a second through groove where the second upper steel ball moving upwards and downwards.

A circular arc camber matching with the first lower steel ball surface is provided both at the bottom of the first ball valve base and at the first oil inlet; and a circular arc camber matching with the second lower steel ball surface is provided both at the bottom of the second ball valve base and at the second oil inlet.

The large pump core is provided with a large pump body, and a cavity formed by a lower end surface of the large pump core and the large pump body is filled with high pressure oil; the lower end of the large pump body is mounted on a groove of the lower valve body; a large pressure spring is fixed outside the large pump body, and one end thereof is fixed with the lower valve body; a large sheath covers the outside of the large pressure spring; the large pump core links the hand press axially, and the surface of the top of the large pump core is in contact with the roller mounted on the hand press.

The small pump core is provided with a small pump body, and a cavity formed by a lower end surface of the small pump core and the small pump body is filled with high pressure oil; the lower end of the small pump body is mounted on the groove of the lower valve body; a small pressure spring is fixed outside the small pump body, and one end thereof is fixed with the lower valve body; a small sheath covers the outside of the small pressure spring; the small pump core links the hand press axially, and the surface of the top of the small pump core is in contact with the roller mounted on the hand press.

When first and second driving levers are pushed to the left of the handle, the working principles of the invention under the no-load condition and those under the load conditions are the same as those of the existing jacks. The large pump core is adjusted to low pressure when the jack quickly lifting under no-load condition while the small pump is adjusted to a high pressure, and the large pump core only works under no-load condition. Under the joint action of the large and small pump cores, the jack lifts quickly; when there is a load, the pressure regulating valve of the large pump core unloads while the first lower steel ball of the first pressure regulation mechanism connected with the large pump core is pushed away, the first oil inlet is opened, and the hydraulic oil in the large pump core is directed to the oil tank from the first oil outlet through the first oil inlet. Under load condition, only the small pump core works and the load is lifted slowly.

When it is necessary to quickly lift a light load, the first and second driving levers are pushed to the right side of the handle, the pressure of the large pump increases and the pressure of the small pump decreases. Specifically, a first cam on the large pump core leans against the first upper steel ball, while the first upper steel ball moves downwards, and the first valve core moves downwards the same distance pushed by the first pressure spring, the first pressure spring is compressed. Correspondingly, the second cam on the small pump core moves the second upper steel ball upwards a certain distance, the second upper steel ball drives the second thimble to move upwards, and the second thimble drives the second valve core to move upwards the same distance, and the second pressure spring is relieved. By pushing the first and second driving levers, the pressure of the large pump increases and the pressure of the small pump decreases, to make the pressure of the two pumps basically the same while the preload of the first pressure spring is the same as that of the second pressure spring. At this time, when the light load does not exceed the preload of the first or the second pressure spring, the first and second oil inlets are always blocked, respectively, by the first and second upper steel balls, the hydraulic oil in the large pump core and small pump core flows into the cylinder, under the joint action of two pumps, the jack lifts rapidly under the light load condition. When exceeding the preload of the first or second pressure spring, the two pumps relieve pressure simultaneously.

The present invention can achieve the following advantages: the present invention has a simple structure. By pushing the first and second driving levers, the pressure of the large pump increases and the pressure of the small pump decreases, to make the pressure of the two pumps basically the same. Under the joint action of two pumps, it can lift rapidly under a light load condition. In addition, the pressure of the small pump can be lowered to protect the stressed member that drive two pumps (such as hand press, wallboard, handle, etc.) from overloaded deformation.

DETAILED DESCRIPTION OF THE EMBODIMENTS

Figure 1A:
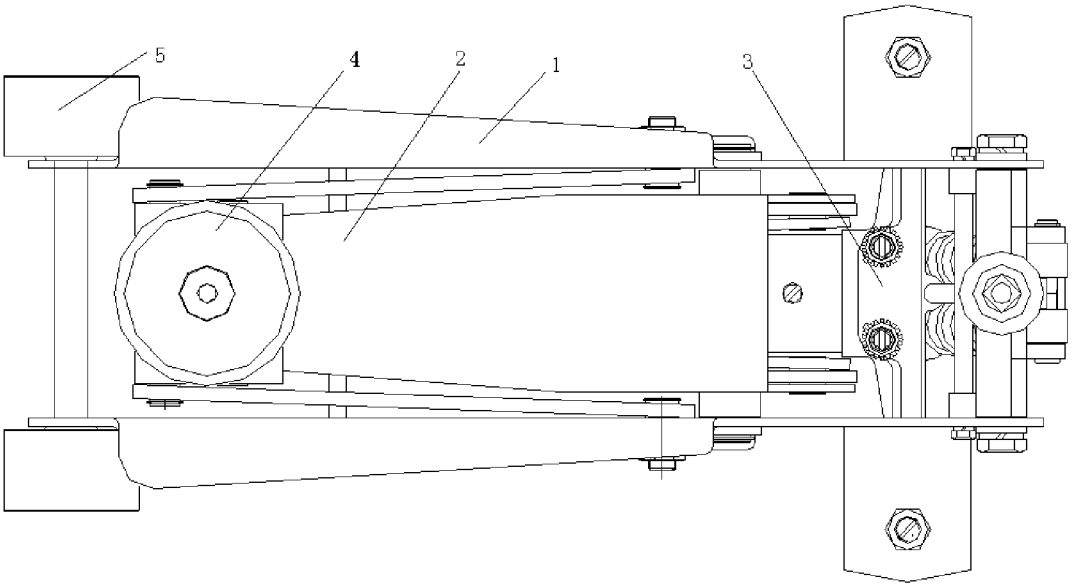
FIG. 1*a* is a top view of the overall structure of a hydraulic jack of the present invention.
Figure 1B:
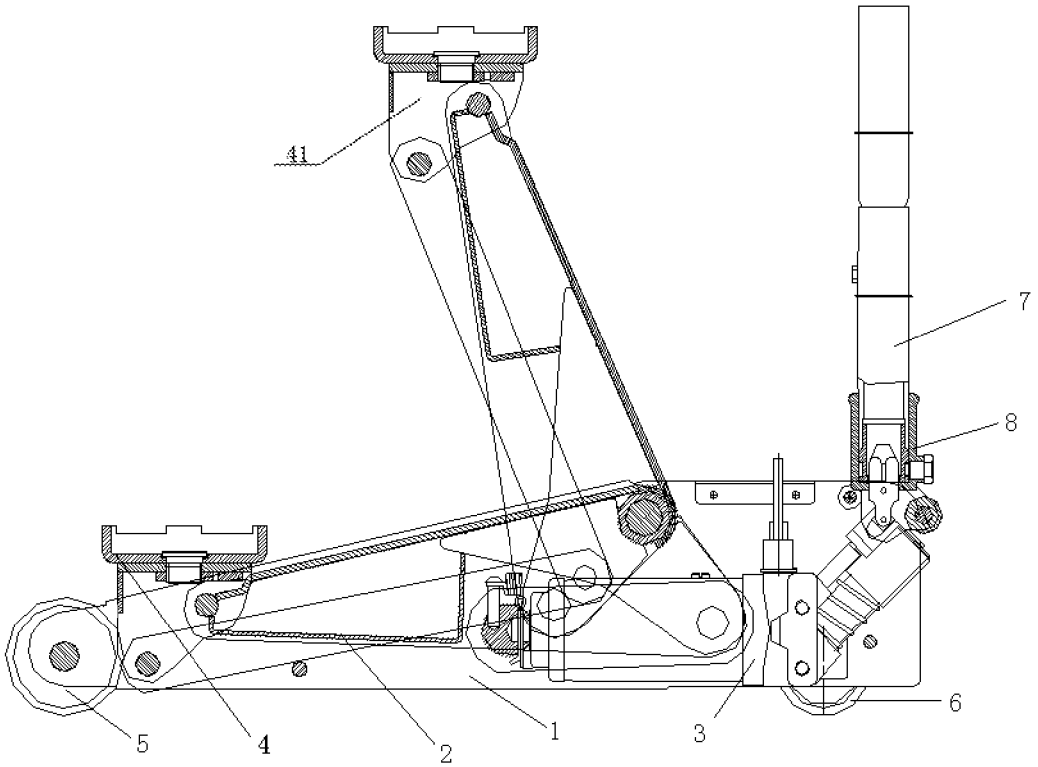
FIG. 1*b* is a schematic view of operation state of a hydraulic jack of the present invention.
Figure 1C:
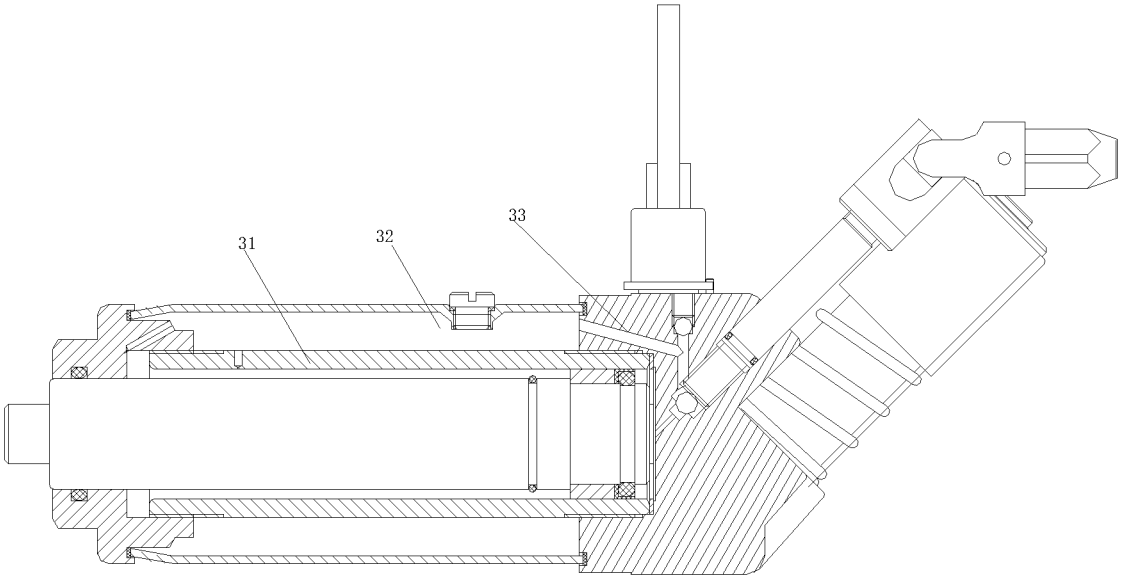
FIG. 1*c* is a cross-sectional view of the overall structure of the present invention.
Figure 2A:
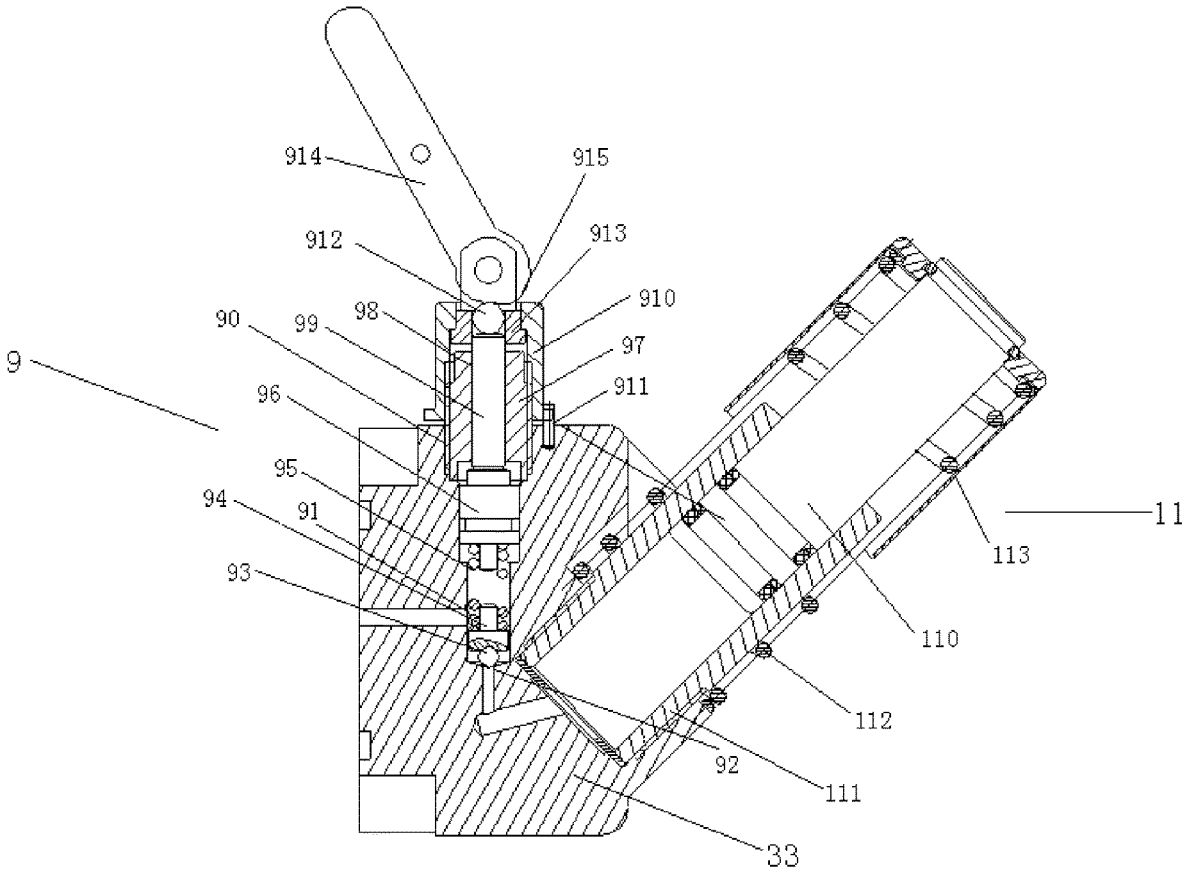
FIG. 2*a* is a schematic view of a large pump and a first pressure regulation mechanism of the present invention.
Figure 2B:
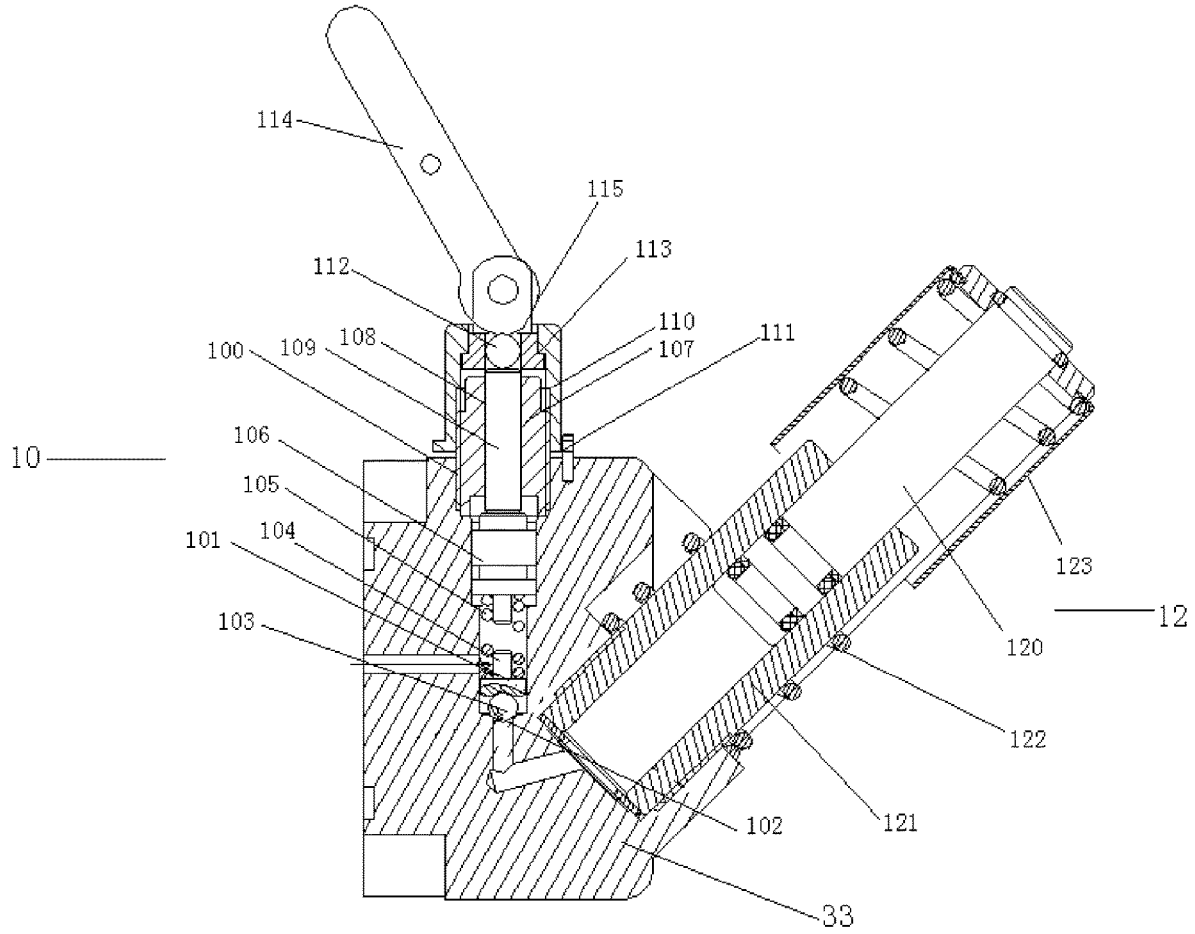
FIG. 2*b* is a schematic view of a small pump and a second pressure regulation mechanism of the present invention.
Figure 3:
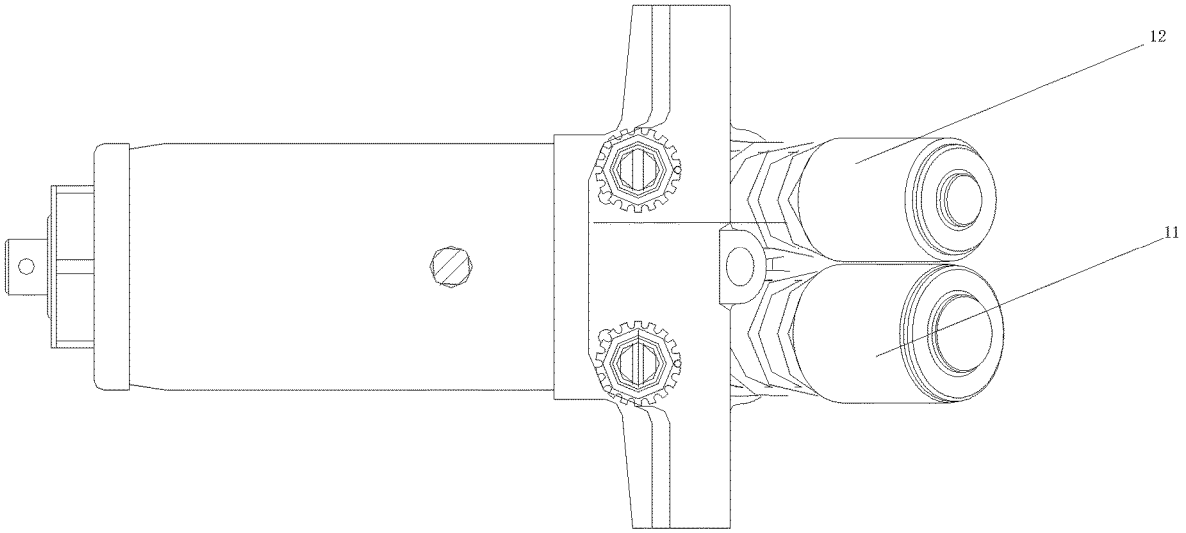
FIG. 3 is top view of partial structure of the present invention.
Figure 4:
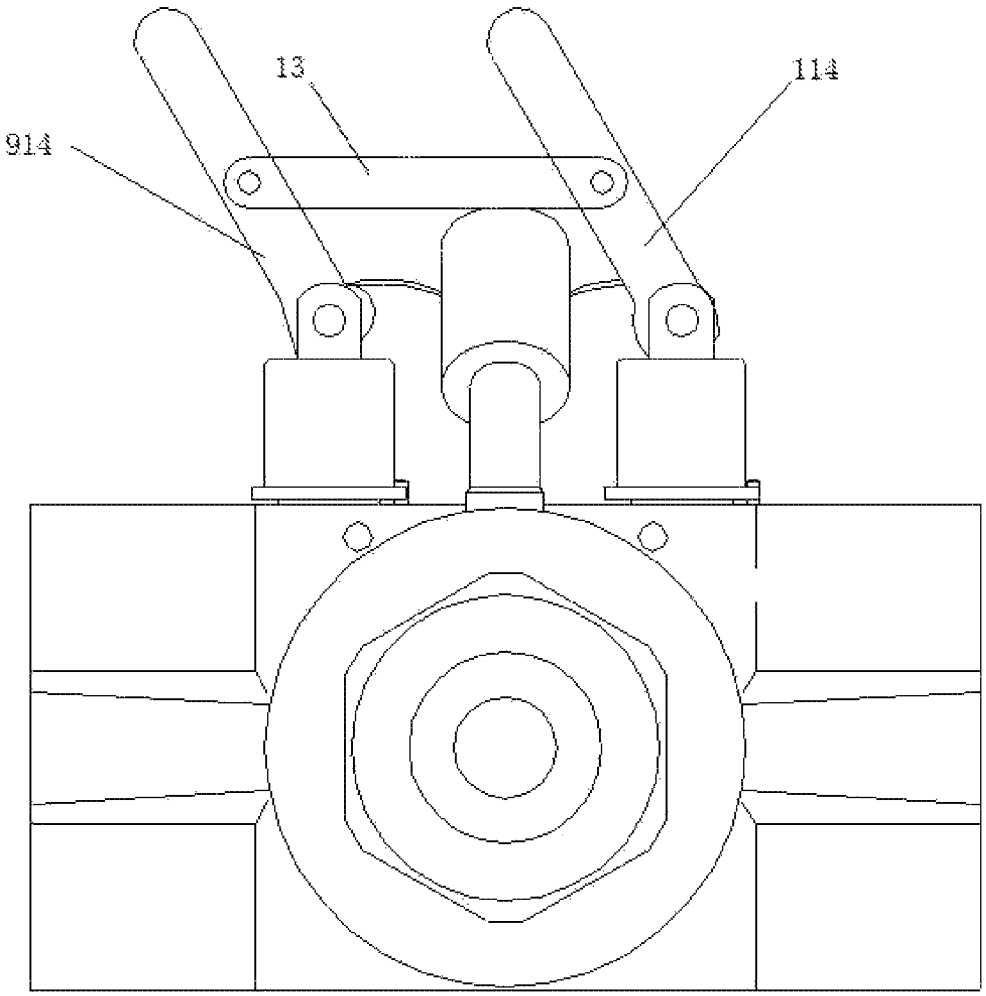
FIG. 4 is a schematic view of the connection between a first driving lever and a second driving lever of the present invention.
Figure 5A:
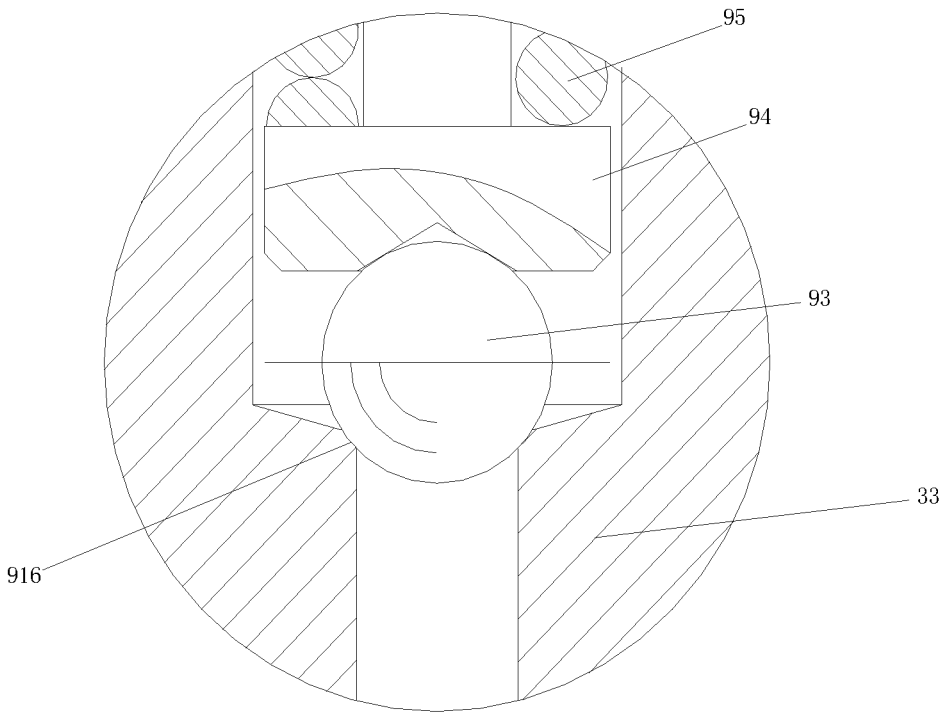
FIG. 5*a* is a partial enlarged view of a circular arc camber matching with a first ball valve base, a first oil inlet and a first lower steel ball of the present invention.
Figure 5B:
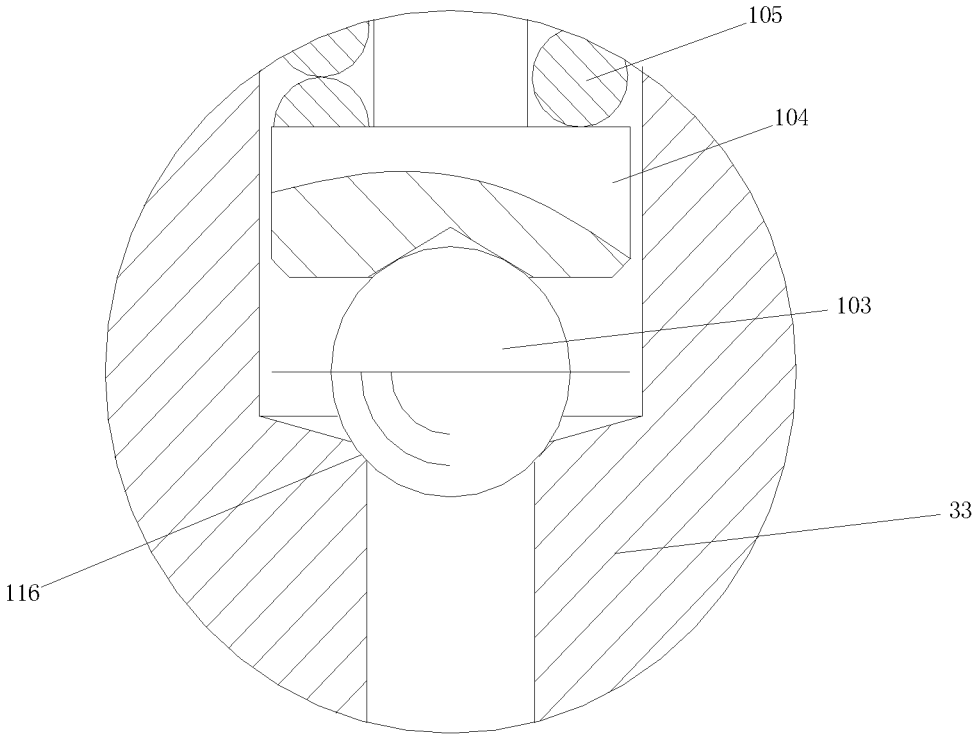
FIG. 5*b* is a partial enlarged view of a circular arc camber matching with a second ball valve base, a second oil inlet and a second lower steel ball of the present invention.
Figure 6A:
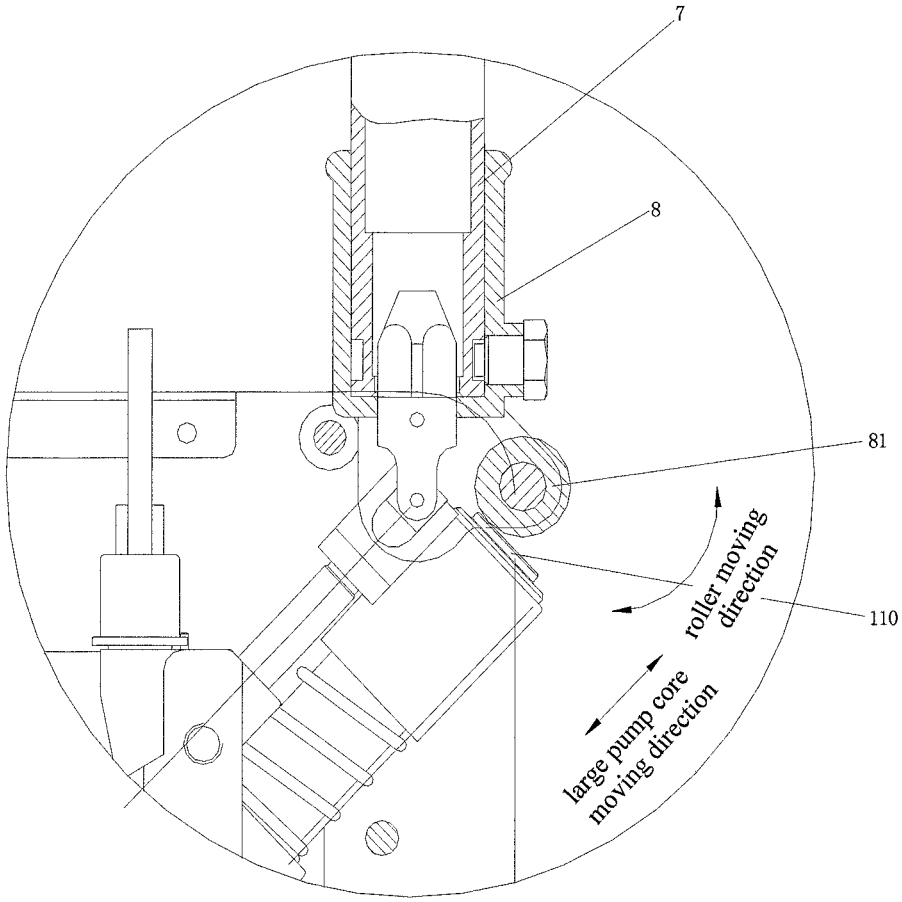
FIG. 6*a* is a partial enlarged view of a hand press and a roller matching with a large pump core.
Figure 6B:
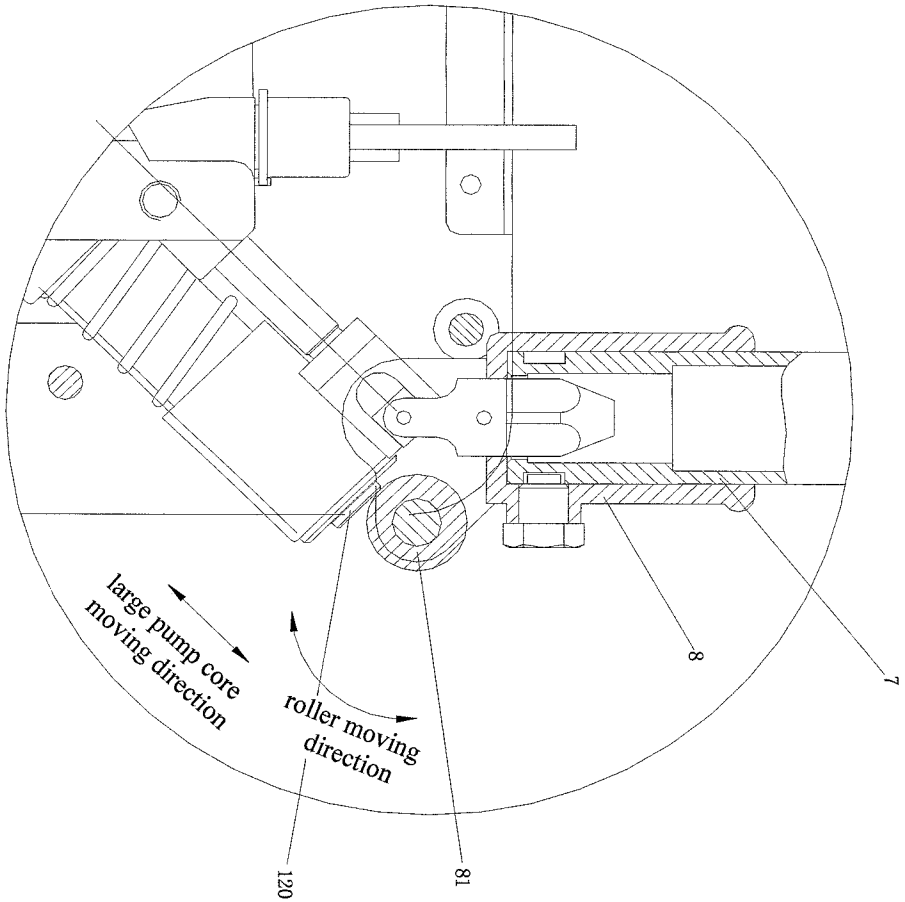
FIG. 6*b* is a partial enlarged view of a hand press and a roller matching with a small pump core.

Referring to FIG. 1*a* to FIG. 7*b*, a hydraulic jack capable of quickly lifting a load, including a frame 1 with a front wheel 5 and a rear wheel 6. The frame 1 is mounted with a lifting arm 2, a long connecting rod, a tray 4, a bracket 41 and a hydraulic oil pump 3 for driving the lifting arm 2. A handle 7 connected with the hydraulic oil pump 3 through a hand press 8, and the hydraulic jack further includes a large pump 11 and a small pump 12 for supplying high pressure oil to the hydraulic oil pump 3. An inner cavity of the large pump 11 and an inner cavity of the small pump 12 are respectively in communication with a hydraulic ram 31, and a large pump core 110 and a small pump core 120 are axially connected to a hand press 8 respectively, and top surfaces of the large pump core and that of the small pump core are in contact with rollers 81 mounted on the hand pressure 8 respectively; wherein the inner cavity of the large pump 11 is in communication with a first pressure regulation mechanism 9, and the inner cavity of the small pump 12 is in communication with a second pressure regulation mechanism 10.

The first pressure regulation mechanism 9 includes a first upper valve body 90 mounted on a lower valve body 33, a first oil outlet 91 communicating an oil compartment 32 and a first upper valve body 90 is provided on a side wall thereof, and a first oil inlet 92 communicating the inner cavity of the large pump 11 is provided at the bottom thereof; a central hole of the first upper valve body 90 is sequentially provided from bottom to top with a first lower steel ball 93 capable of blocking the first oil inlet 92, a first ball valve base 94, a first pressure spring 95, a first valve core 96 and a first valve rod 97, the first pressure spring 95 being installed between the first ball valve base 94 and the first valve core 96, and the first valve rod 97 is provided with a first central through-hole 98 where a first thimble 99 passes through and the lower end thereof is connected with the first valve core 96, and the first thimble 99 drives the first valve core 96 to move up and down along the axis of the first upper valve body 90; a first adjustment screw nut 910 for adjusting the set pressure is installed on the top of the first valve rod 97, and the lower end of the first adjustment screw nut 910 is connected fixedly with a lower valve body 33 through a first stop pin 911; the top of the first adjustment screw nut 910 is provided with an opening where a first upper steel ball 912 is provide, the lower end of the first upper steel ball 912 leans against the first thimble 99;

The second pressure regulation mechanism 10 includes a second upper valve body 100 mounted on a lower valve body 33, a second oil outlet 101 communicating oil compartment 32 and a second upper valve body 100 is provided on a side wall thereof, and a second oil inlet 102 communicating with the inner cavity of the small pump 12 is provided at the bottom thereof; a central hole of the second upper valve body 100 is sequentially provided from bottom to top with a second lower steel ball 103 capable of blocking the second oil inlet 192, a second ball valve base 104, a second pressure spring 105, a second valve core 106 and a second valve rod 107, the second pressure spring 105 being installed between the second ball valve base 104 and the second valve core 106, and the second valve rod 107 is provided with a second central through-hole 108 where a second thimble 109 passes through and the lower end thereof is connected with the second valve core 106, and the second thimble 109 drives the second valve core 106 to move up and down along the axis of the second upper valve body 100; a second adjustment screw nut 110 adjusting the set pressure is installed on the top of the second valve rod 107, and the lower end of the second adjustment screw nut 110 is connected fixedly with a lower valve body 33 through a second stop pin 111; the top of the second adjustment screw thread 110 is provided with an opening where a second upper steel ball 112 is provide, and the lower end of the second upper steel ball 112 leans against the second thimble 109;

A first cam 915 is installed at the bottom of a first driving lever 914. The first cam 915 is hinged at the top of the first upper valve body 90 and leans against the upper end of a first upper steel ball 912. A second cam 115 is installed at the bottom of a second driving lever 114 and the second cam 115 is hinged at the top of the second upper valve body 100 and leans against the upper end of a second upper steel ball 112; the ends of the connecting rod 13 are hinged on the first driving lever 914 and the second driving lever 114, respectively; the phase of the first cam 915 is opposite to that of the second cam 115.

The first upper steel ball 912 is mounted in a first mounting base 913, the second upper steel ball 112 is mounted in a second mounting base 113, the first mounting base 913 is provided with a first through groove where the first upper steel ball 912 moving upwards and downwards, and the second mounting base 113 is provided with a second through groove where the second upper steel ball 112 moving upwards and downwards.

A circular arc camber 916 matching with the first lower steel ball 93 surface is provided both at the bottom of the first ball valve base 94 and at the first oil inlet 92; and a circular arc camber 116 matching with the second lower steel ball 103 surface is provided both at the bottom of the second ball valve base 104 and at the second oil inlet 102.

The large pump core 110 is provided with a large pump body 111, and a cavity formed by the lower end surface of the large pump core 110 and the large pump body 111 is filled with high pressure oil; the lower end of the large pump body 111 is mounted on the groove of the lower valve body 33; a large pressure spring 112 is fixed outside the large pump body 111, and one end thereof is fixed with a lower valve body 33; a large sheath 113 covers the outside of the large pressure spring 112; the large pump core 110 links a hand press 8 axially, and the surface of the top of the large pump core 110 leans against a roller 81 mounted on the hand press 8.

The small pump core 120 is provided with a small pump body 121, and a cavity formed by the lower end surface of the small pump core 120 and the small pump body 121 is filled with high pressure oil; the lower end of the small pump body 121 is mounted on the groove of the lower valve body 33; a small pressure spring 122 is fixed outside the small pump body 121, and one end thereof is fixed with a lower valve body 33; a small sheath 123 covers the outside of the small pressure spring 122; the small pump core 120 links a hand press 8 axially, and surface of the top of the small pump core 120 is in contact with a roller 81 mounted on the hand press 8.

Figure 7A:
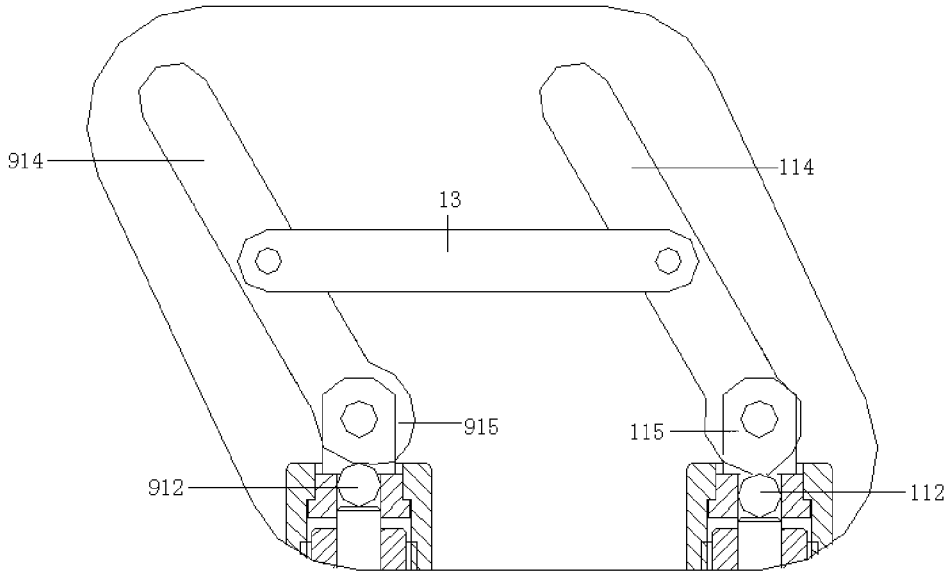
FIG. 7*a* is a phase diagram of a first cam and a second cam under no-load or heavy load condition.
Figure 7B:
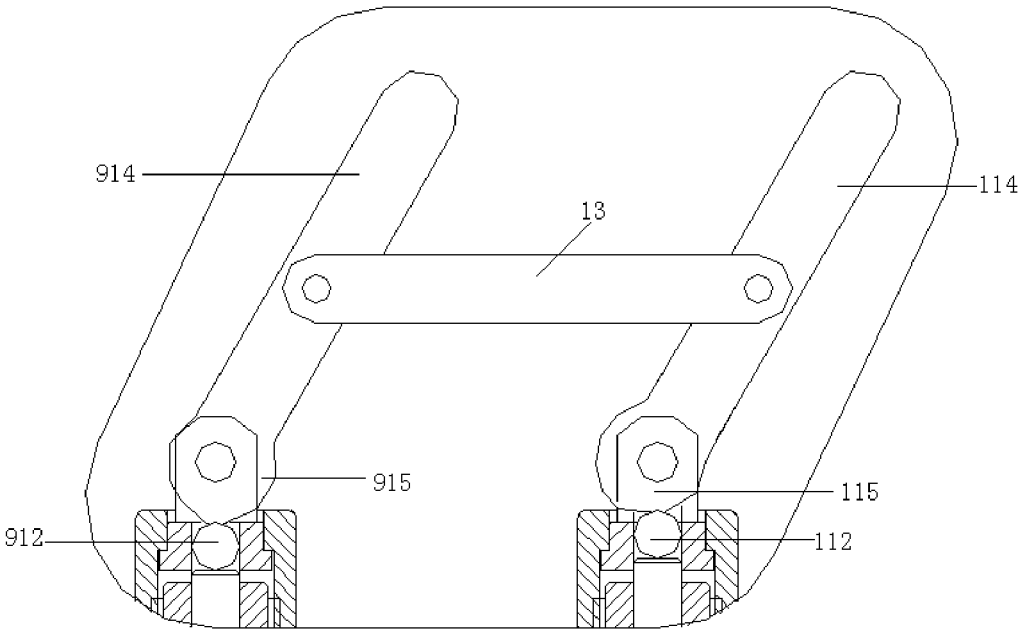
FIG. 7*b* is a phase diagram of a first cam and a second cam under light load condition.

When first and second driving levers 914, 114 are pushed to the left of the handle, as shown in FIG. 7*a*, the working principles of the invention under no-load condition and that under the load condition are the same as those of the existing jacks. The large pump core is adjusted to a low pressure when the jack quickly lifting under no-load condition while the small pump is adjusted to a high pressure, and the large pump core only works under no-load condition. Under the joint action of the large and small pump cores, the jack lifts quickly; when there is a load, the pressure regulating valve of the large pump core unloads while the first lower steel ball of the first pressure regulation mechanism connected with the large pump core is pushed away, the first oil inlet is opened, and the hydraulic oil in the large pump core is directed to the oil tank from the first oil outlet through the first oil inlet. Under load condition, only the small pump core works and the load is lifted slowly.

Referring to FIG. 7*a*, when it is required to quickly lift a light load, the first and second driving levers 914,114 are pushed to the right side of the handle, the pressure of the large pump increases and the pressure of the small pump decreases. Specifically, a first cam 915 on the large pump core leans against the first upper steel ball 912 while the first upper steel ball 912 moves downwards, and the first valve core moves downwards the same distance pushed by the first pressure spring, the first pressure spring is compressed.

Correspondingly, the second cam on the small pump core moves the second upper steel ball upwards a certain distance, the second upper steel ball drives the second thimble to move upwards, and the second thimble drives the second valve core to move upwards the same distance, and the second pressure spring is relieved. By pushing the first and second driving levers, the pressure of the large pump increases and the pressure of the small pump decreases, to make the pressure of the two pumps basically the same while the preload of the first pressure spring in the same as that of the second pressure spring. At this time, when the light load does not exceed the preload of the first or the second pressure spring, the first and second oil inlets are always blocked respectively by the first and second upper steel balls, the hydraulic oil in the large pump core and small pump core flows into the cylinder, under the joint action of two pumps, and the jack lifts rapidly under the light load condition. When exceeding the preload of the first or second pressure spring, the two pumps release pressure simultaneously.

The embodiments herein are only the listed forms of the invention concepts. The scope of protection herein shall not be construed as being limited to the specific forms set forth in the embodiments, and all equivalent technical means that can be conceived by those skilled in the art shall fall into the scope of protection herein.

The invention claimed is:

1. A hydraulic jack capable of quickly lifting a load, comprising a frame with a front wheel and a rear wheel; wherein the frame is mounted with a lifting arm, a long connecting rod, a tray, a bracket and a hydraulic oil pump for driving the lifting arm, a handle connected with the hydraulic oil pump through a hand press, and the hydraulic jack further comprises a large pump and a small pump for supplying high pressure oil to the hydraulic oil pump, an inner cavity of the large pump and an inner cavity of the small pump are respectively in communication with a hydraulic ram, and a large pump core and a small pump core are axially connected to the hand press respectively, and a top surface of the large pump core and a top surface of the small pump core are respectively in contact with rollers mounted on the hand press respectively; wherein the inner cavity of the large pump is in communication with a first pressure regulation mechanism, and the inner cavity of the small pump is in communication with a second pressure regulation mechanism;

wherein the first pressure regulation mechanism comprises a first upper valve body mounted on a lower valve body, a first oil outlet communicating with an oil compartment and the first upper valve body, and a first oil inlet communicating with the inner cavity of the large pump is provided at the bottom of the large pump; a central hole of the first upper valve body is sequentially provided from a bottom to a top with a first lower steel ball capable of blocking the first oil inlet, a first ball valve base, a first pressure spring, a first valve core and a first valve rod; the first pressure spring being installed between the first ball valve base and the first valve core, and the first valve rod is provided with a first central through-hole where a first thimble passes through and a lower end of the first central through hole is connected with the first valve core, and the first thimble drives the first valve core to move up and down along the axis of the first upper valve body; a first adjustment screw nut adjusting the set pressure is installed on the top of the first valve rod, and the lower end of the first adjustment screw nut is connected fixedly with the lower valve body through a first stop pin; the top of the first adjustment screw nut is provided an opening where a first upper steel ball is provided, the lower end of the first upper steel ball leans against the first thimble;

the second pressure regulation mechanism comprises a second upper valve body mounted on the lower valve body, a second oil outlet communicating with the oil compartment and the second upper valve body, and a second oil inlet communicating with the inner cavity of the small pump is provided at the bottom of the small pump; a central hole of the second upper valve body is sequentially provided from a bottom to a top with a second lower steel ball capable of blocking the second oil inlet, a second ball valve base, a second pressure spring, a second valve core and a second valve rod, the second pressure spring being installed between the second ball valve base and the second valve core, and the second valve rod is provided with a second central through-hole where a second thimble passes through and a lower end of the second central through hole is connected with the second valve core, and the second thimble drives the second valve core to move up and down along the axis of the second upper valve body; a second adjustment screw nut adjusting the set pressure is installed on the top of the second valve rod, and the lower end of the second adjustment screw nut is connected fixedly with a lower valve body through a second stop pin; the top of the second adjustment screw nut is provided an opening where a second upper steel ball is provided, and the lower end of the second upper steel ball leans against the second thimble;

a first cam installed at the bottom of a first driving lever and hinged at the top of the first upper valve body leans against the upper end of the first upper steel ball; a second cam installed at the bottom of a second driving lever and hinged at the top of the second upper valve body leans against the upper end of the second upper steel ball; the ends of the connecting rod are hinged on the first driving lever and the second driving lever respectively.

2. The hydraulic jack capable of quickly lifting a load according to claim 1, wherein the first upper steel ball is mounted in a first mounting base, the second upper steel ball is mounted in a second mounting base, the first mounting base is provided with a first through groove where the first upper steel ball moving upwards and downwards, and the second mounting base is provided with a second through groove where the second upper steel ball moving upwards and downwards.

3. The hydraulic jack capable of quickly lifting a load according to claim 2, wherein a circular arc camber matching with the first lower steel ball surface is provided both at the bottom of the first ball valve base and at the first oil inlet; and a circular arc camber matching with the second lower steel ball surface is provided both at the bottom of the second ball valve base and at the second oil inlet.

4. The hydraulic jack capable of quickly lifting a load according to claim 3, wherein the large pump core is provided with a large pump body, and a cavity formed by a lower end surface of the large pump core and the large pump body is filled with high pressure oil; the lower end of the large pump body is mounted on a groove of the lower valve body; a large pressure spring is fixed outside the large pump body, and one end thereof is fixed with the lower valve body; a large sheath covers the outside of the large pressure spring; the large pump core links the hand press axially, and the surface of the top of the large pump core is in contact with the roller mounted on the hand press.

5. The hydraulic jack capable of quickly lifting a load according to claim 4, wherein the small pump core is provided with a small pump body, and a cavity formed by a lower end surface of the small pump core and the small pump body is filled with high pressure oil; the lower end of the small pump body is mounted on the groove of the lower valve body; a small pressure spring is fixed outside the small pump body, and one end thereof is fixed with the lower valve body; a small sheath covers the outside of the small pressure spring; the small pump core links the hand press axially, and the surface of the top of the small pump core is in contact with the roller mounted on the hand press.

* * * * *